US005186182A

United States Patent [19]

Lin

[11] Patent Number: 5,186,182

[45] Date of Patent: Feb. 16, 1993

[54] ASH TRAY

[76] Inventor: Tung-Ming Lin, No. 17, Lane 997, Chung Cheng North Road, Yung Kang Hsiang, Tainan Hsien, Taiwan

[21] Appl. No.: 788,786

[22] Filed: Nov. 6, 1991

[51] Int. Cl.[5] ..... A24F 19/00; A24F 19/14

[52] U.S. Cl. ..... 131/241; 131/240.1; 131/235.1; 131/256

[58] Field of Search ..... 131/231, 235.1, 236, 131/237, 240.1, 241, 242, 242.6, 256

[56] References Cited

U.S. PATENT DOCUMENTS

| | | | |
|---|---|---|---|
| 1,472,804 | 11/1923 | Mack | 131/236 |
| 1,902,014 | 3/1933 | Campbell | 131/240.1 |
| 1,915,214 | 6/1933 | Caldwell | 131/236 |
| 2,172,161 | 9/1939 | DuPrey | 131/240.1 |
| 2,596,773 | 9/1952 | Horikawa | 131/236 X |
| 2,844,153 | 7/1958 | Pararra | 131/240.1 |
| 5,038,801 | 8/1991 | Wang | 131/236 |

FOREIGN PATENT DOCUMENTS

| | | | |
|---|---|---|---|
| 515901 | 12/1939 | United Kingdom | 131/240.1 |

*Primary Examiner*—V. Millin
*Assistant Examiner*—J. Doyle
*Attorney, Agent, or Firm*—Morton J. Rosenberg; David I. Klein

[57] ABSTRACT

An ash tray having a vessel formed with an open top and an internal flange for supporting a cigarette rest bracket and a side entrance for removably sliding a drawer-like receptacle into a lower portion of the vessel. The cigarette rest bracket having a plurality of cigarette rest members fromed by a pair of spaced triangular plates which sequentially defines a first trough with its gap larger than the diameter of a standard cigarette and a second trough with its gap smaller than the diameter of a standard cigarette thereby a lighted cigarette positioning on the cigarette rest member will finally fall through the first trough into the drawer-like receptacle and be extinguished by an extinguishing fluid contained within the receptacle.

3 Claims, 5 Drawing Sheets

B

A - A

ASH TRAY

BACKGROUND OF THE INVENTION

The present invention relates to ash trays and more particularly to ash trays of the type having a removable receptacle for receiving smokers' waste such as ashes and butts.

A common type of ash tray, as shown in FIG. 1, includes a vessel 1 having an upright side wall and a plurality of slots or notches 12 functioning as rests for holding cigarettes evenly distributed in the top end of the upright side wall. This known ash tray has been found unsatisfactory for the following reasons:

1) Frequently the refuse or dregs are still smoldering or even lit and, depositing such material in this known ash tray can result in inconvenient, noxious or even disastrous consequences; and 2) To empty this ash tray, the lightweight ashes being extremely susceptible to even mild air currents frequently settle on the area surrounding the ash tray.

OBJECTS OF THE INVENTION

It is accordingly a primary object of the present invention to provide an ash tray which extinguishes lit or smoldering refuse deposited therein.

Another object of the present invention is to provide an ash tray which is conveniently emptied.

A still further object of the present invention is to provide an ash tray wherein the smokers' waste is automatically saturated with fire-extinguishing fluid.

DETAILED DESCRIPTION OF PREFERRED EMBODIMENT

Figure 1:
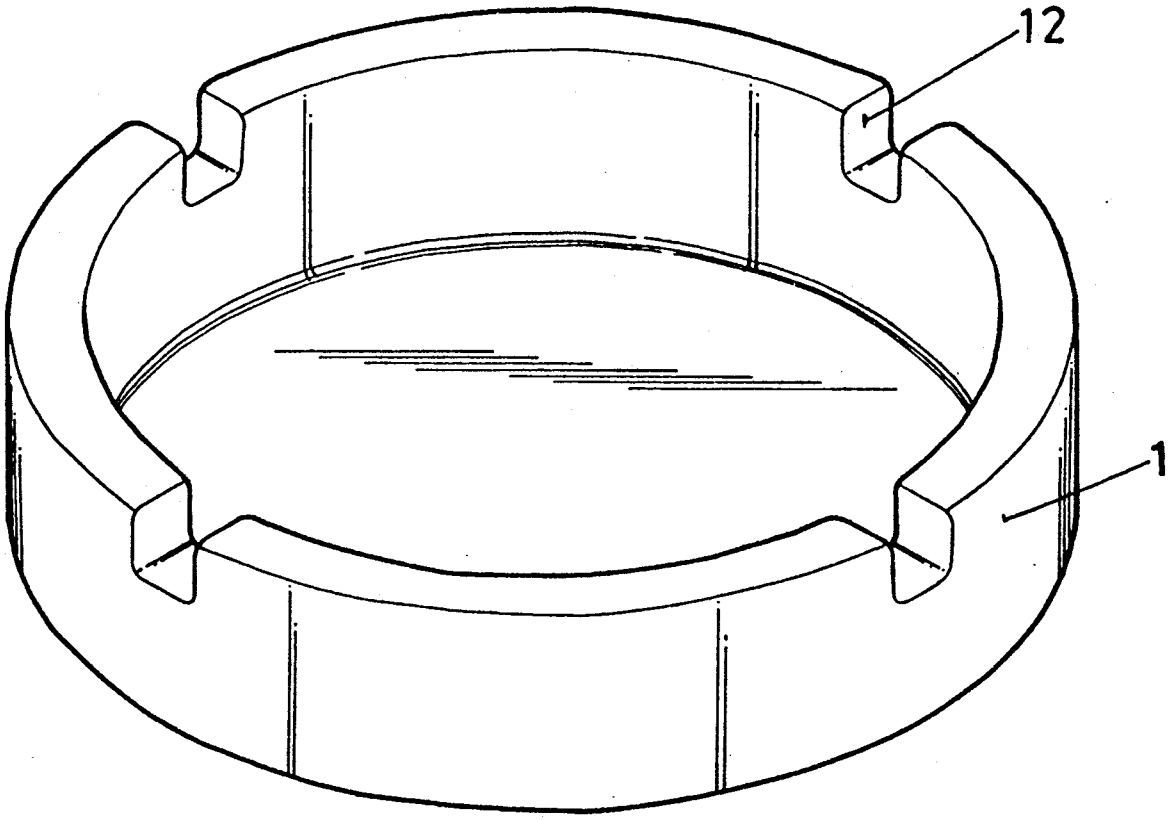
(PRIOR ART) FIG. 1
FIG. 1 is a perspective view of a known ash tray.
Figure 2:
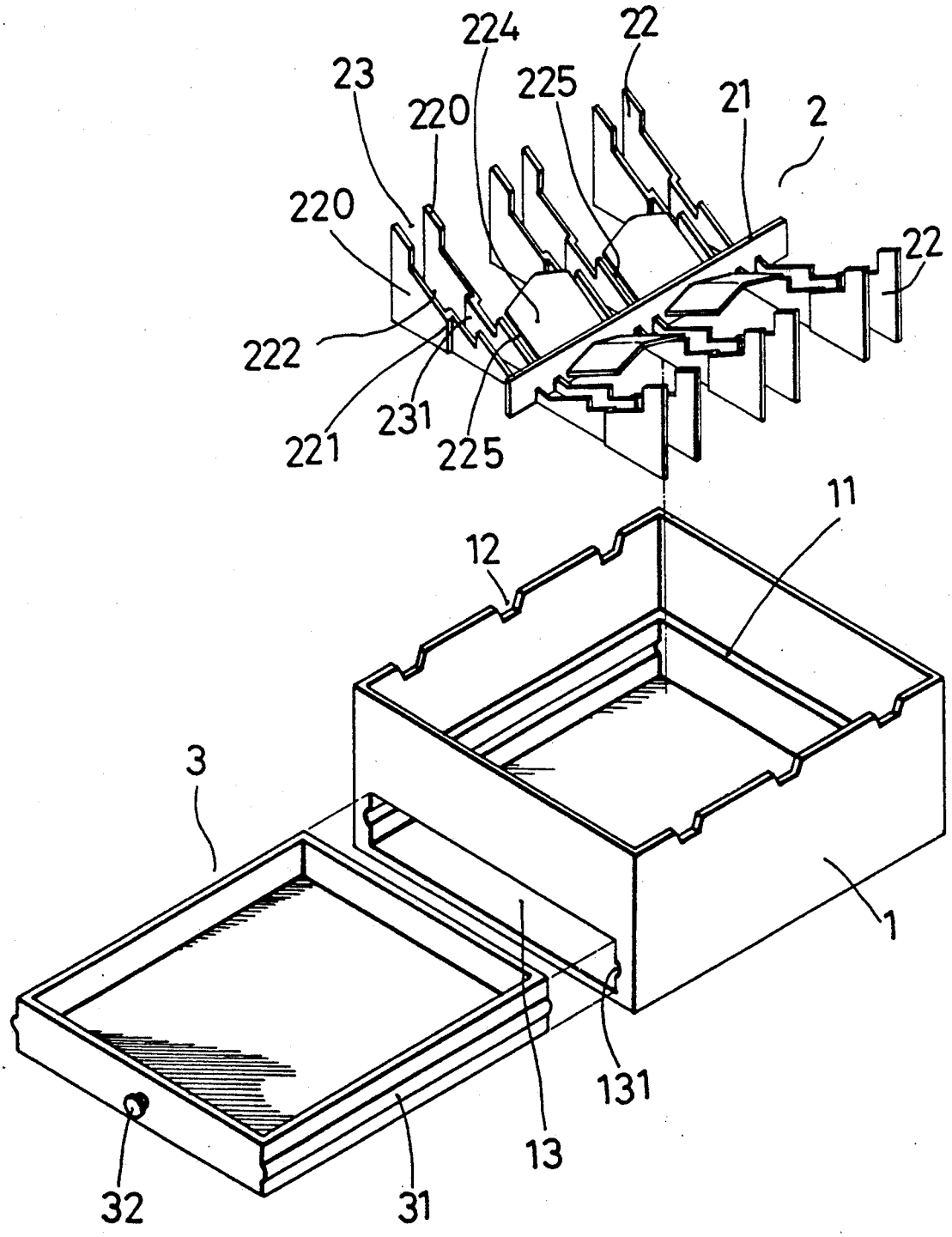
FIG. 2 is an exploded perspective view of an ash tray according to the present invention.
Figure 3:
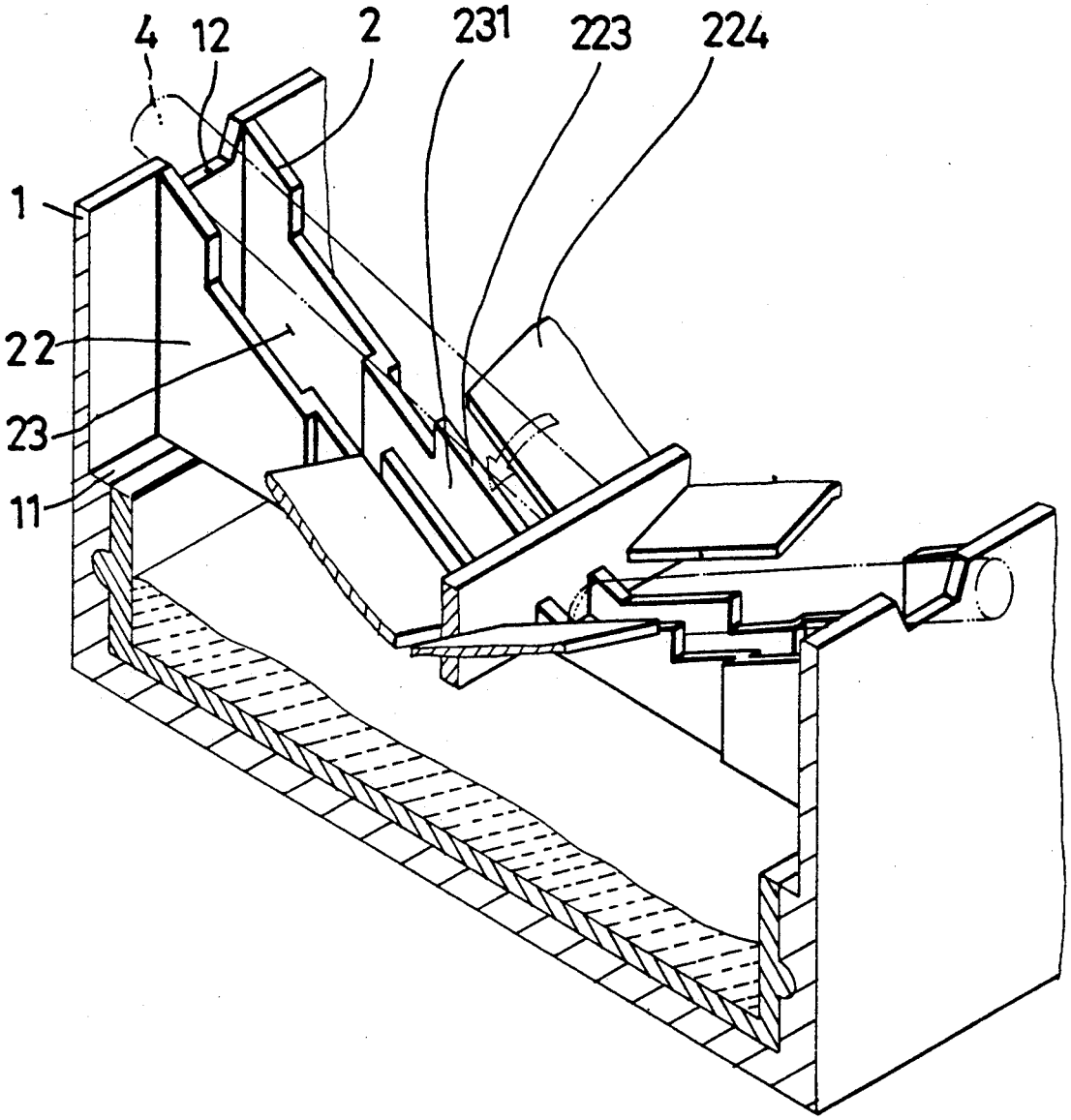
FIG. 3 is an enlarged perspective view of a cigarette rest portion of the ash tray of the present invention in an assembled condition.
Figure 4:
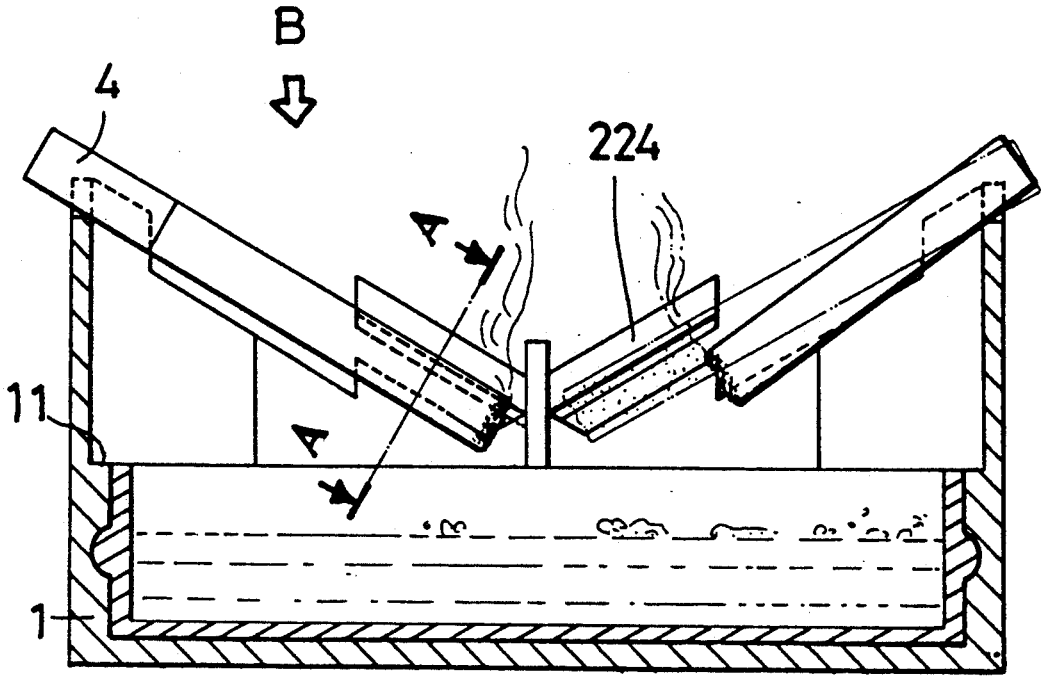
FIG. 4 is a cross-sectional view of the ash tray of the present invention.
Figure 5:
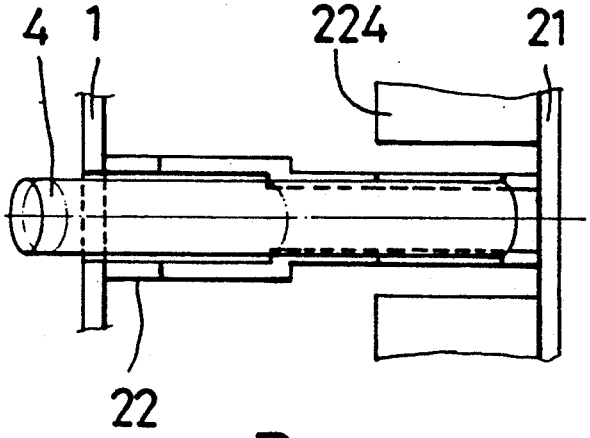
FIG. 5 is a top elevation of a cigarette rest portion taken from B section of FIG. 4.
Figure 6:
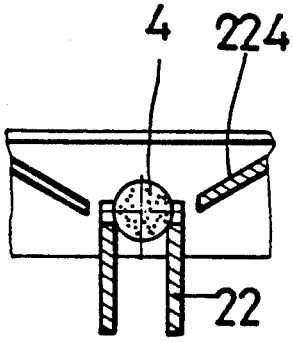
FIG. 6 is a sectional view taken along line A—A of FIG. 4.

Referring to FIG. 1, an ash tray of a preferred embodiment according to the present invention mainly comprises a vessel 1 of cubic structure, a cigarette rest bracket 2 and a drawer-like receptacle 3.

The vessel 1 includes upright side walls and a bottom. One of the upright side walls is formed with a substantially rectangular opening 13, which functions as an entrance of the drawer-like receptacle 3, in a lower portion thereof. A plurality of slots or notches 12 are formed at the top of a pair of opposed side walls of the upright side walls. At least three of the upright side walls of the vessel 1 step downward to define an internal flange 11 for supporting the cigarette rest bracket 2 within the vessel 1. A pair of guide grooves 131 extending longitudinally along a pair of opposed side walls of the upright side walls and terminating at the entrance 13 are provided in lower inner side walls of the opposed side walls for guiding the drawer-like receptacle 3, which is formed with a pair of projecting guider 31 located on external side walls of a pair of opposed side walls thereof and mating the guide grooves 131, to slide into and out of the vessel 1 through the entrance 13.

The cigarette rest bracket 2 includes a middle compartment 21 and two series of cigarette rest members 22, each series having three cigarette rest members 22 evenly spaced apart, arranged in opposite sides of the middle compartment 21. Each cigarette rest member 22 includes a pair of parallel triangular plates 220 defining a trough 23. The gap or distance between the triangular plates 220 of the cigarette rest member 22 is properly larger than the diameter of a standard cigarette. The middle portion of the triangular plates 221 step inwardly towards each other to define a narrower trough 231 of which the gap or distance between the frontal portion of the triangular plates 220 is less than the diameter of a standard cigarette. The top sloping sides of the triangular plates 220 are correspondingly formed with respective cut-off portions 222 along a major portion thereof.

Between adjacent cigarette rest members 22, there is provided with a gable 224 having two sloping plates sloping laterally toward the frontal portions of the adjacent triangular plates 220 of the cigarette rest members 22 to define respective gaps 225.

Referring to FIGS. 3 to 6, the cigarette rest bracket 2 is accommodated within an upper portion of the vessel 1 by resting the bottom of the bracket 2 on the internal flange 11 wherein the trough 23 of each of the cigarette rest members 22 corresponds to a slot 12 formed in the top end of the vessel 1. A cigarette 4 can be positioned on a cigarette rest member 22 in a way that the filter end of the cigarette 4 is retained in the corresponding slot 12 and the frontal end is positioned on the frontal end 223 of the rest member 22. Said sloping side plate of the gable 224 prevents the frontal end of the cigarette 4 from rolling sidewise.

Figure 7:
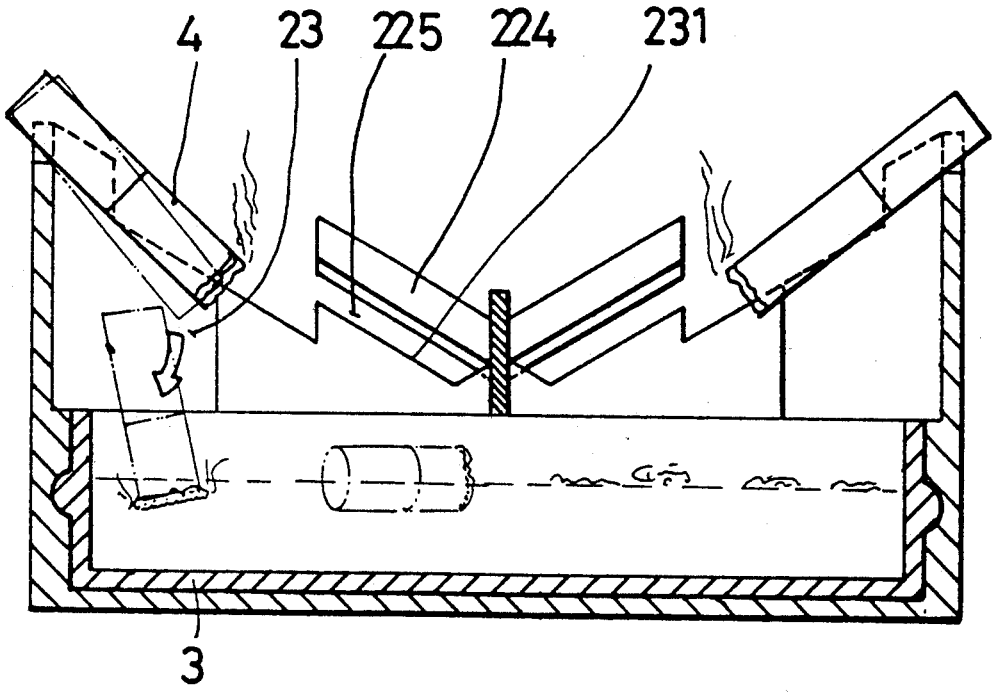
FIG. 7 is a diagrammatic and cross-sectional view of the ash tray of the present invention.

In use, as shown in FIG. 7, a limited quantity of extinguishing fluid such as water resides within the receptacle 3. Frequently, a smoker may carelessly leave his lighted cigarette for an extended period of time. Under such circumstance, ashes of this lighted cigarette 4 drop through narrower trough 231 into the receptacle 3 and, finally, lighted cigarette butt 4 will automatically fall through the trough 23 into the receptacle 3 and be extinguished by the fluid contained therein.

What is claimed is:

1. An ash tray for receiving and extinguishing ashes and butts accumulated therein, said ash tray comprising:

an upright hollow vessel having side walls and an open top, an internal flange and a side opening formed in a lower portion of a side wall thereof;

at least one slot formed in the top end of a side wall of the vessel;

a drawer member adapted to be positioned in a lower portion within the vessel through the side opening and containing a fire-extinguishing fluid;

means for removably sliding the drawer member into the position within the vessel; and a cigarette rest bracket supported on the internal flange in an upper portion above the drawer member within the vessel and having at least one cigarette rest member formed with a pair of spaced triangular plates defining a first trough of which a rear end corresponds to the slot and the distance between the triangular plates is larger than the diameter of a cigarette, frontal portions of said triangular plates stepping inwardly towards each other to define a second trough of which the distance between the frontal portions of the triangular plates is smaller than the distance of the first trough and the diameter of a cigarette such that a lighted cigarette positioned on a sloping top of the cigarette rest member is supported by the slot and said frontal portions of said triangular plates but automatically falls through the first trough into the drawer member when the cigarette burns down to a length such that it no longer extends beyond the first trough and is extinguished by the fire-extinguishing fluid contained in the drawer member.

2. An ash tray as claimed in claim 1, wherein the sloping tops of the triangular plates are correspondingly formed with cut-off portions along a major portion thereof.

3. An ash tray as claimed in claim 1, wherein a gable member is provided between two adjacent cigarette rest members, said gable member includes two sloping side plates sloping laterally towards adjacent triangular plates to prevent a cigarette rested on the cigarette rest member from rolling sidewise.

* * * * *